US011624160B2

(12) United States Patent
Harco

(10) Patent No.: US 11,624,160 B2
(45) Date of Patent: Apr. 11, 2023

(54) PAVING MACHINE MEMBRANE DISPENSER

(71) Applicant: Pavegard Products Inc., Surrey (CA)

(72) Inventor: Peter Harco, Surrey (CA)

(73) Assignee: PAVEGARD PRODUCTS INC., Surrey (CA)

( * ) Notice: Subject to any disclaimer, the term of this patent is extended or adjusted under 35 U.S.C. 154(b) by 0 days.

(21) Appl. No.: 17/475,015

(22) Filed: Sep. 14, 2021

(65) Prior Publication Data

US 2022/0056650 A1 Feb. 24, 2022

Related U.S. Application Data

(63) Continuation of application No. 16/748,662, filed on Jan. 21, 2020, now Pat. No. 11,118,317, which is a continuation of application No. 15/912,325, filed on Mar. 5, 2018, now Pat. No. 10,538,884.

(60) Provisional application No. 62/466,883, filed on Mar. 3, 2017.

(51) Int. Cl.

| | |
|---|---|
| ***E01C 19/20*** | (2006.01) |
| ***E01C 19/52*** | (2006.01) |
| ***E01C 19/48*** | (2006.01) |
| ***E01C 23/04*** | (2006.01) |
| ***E01C 7/16*** | (2006.01) |
| ***E01C 7/32*** | (2006.01) |

(52) U.S. Cl.

CPC ..... *E01C 19/20* (2013.01); *E01C 7/16* (2013.01); *E01C 7/325* (2013.01); *E01C 19/48* (2013.01); *E01C 19/522* (2013.01); *E01C 23/04* (2013.01); *E01C 2019/2055* (2013.01)

(58) Field of Classification Search

CPC . E01C 7/16; E01C 7/325; E01C 19/20; E01C 19/48; E01C 19/522; E01C 23/04; E01C 2019/2055

USPC ..... 404/17–111

See application file for complete search history.

(56) References Cited

U.S. PATENT DOCUMENTS

| | | | |
|---|---|---|---|
| 1,946,819 | A | 2/1934 | Stevenson |
| 2,384,395 | A | 9/1945 | Payne |
| 3,632,054 | A | 1/1972 | Heppelmann et al. |
| 3,814,144 | A | 6/1974 | Spencer |

(Continued)

FOREIGN PATENT DOCUMENTS

| | | |
|---|---|---|
| EP | 0241803 A2 | 10/1987 |
| EP | 0387114 B1 | 12/1992 |

*Primary Examiner* — Raymond W Addie

(74) *Attorney, Agent, or Firm* — Schacht Law Office, Inc.; Michael R. Schacht

(57) ABSTRACT

An asphalt paving system comprising a plurality of dispensing shafts and a plurality of rolls of pavement reinforcing membrane. The plurality of dispensing shafts are adapted to be mounted on an asphalt paving machine, where at least a portion of at least one dispensing shaft extends from at least one side of the paving machine, and at least a portion of at least one dispensing shaft extends to a front of the paving machine. Each roll of pavement reinforcing membrane is supported by one of the plurality of dispensing shafts. As the asphalt paving machine moves, the plurality of dispensing shafts dispense the pavement reinforcing membrane continuously beneath the asphalt paving machine and the hot asphalt material is dispensed from the hopper on top of the pavement reinforcing membrane beneath the asphalt paving machine.

13 Claims, 2 Drawing Sheets

(56) References Cited

U.S. PATENT DOCUMENTS

| | | | |
|---|---|---|---|
| 4,077,731 | A | 3/1978 | Holz et al. |
| 4,456,399 | A | 6/1984 | Conover |
| 4,684,289 | A | 8/1987 | Gnesa |
| 4,705,229 | A | 11/1987 | Barazone |
| 4,742,970 | A | 5/1988 | Barazone |
| 4,793,731 | A | 12/1988 | Gnesa |
| 4,806,043 | A | 2/1989 | Fournier |
| 4,828,432 | A | 5/1989 | Ives |
| 5,135,333 | A | 8/1992 | Guntert et al. |
| 6,444,258 | B1 | 9/2002 | Ferry |
| 6,454,889 | B1 | 9/2002 | Hendrix et al. |
| 6,776,557 | B2 | 8/2004 | Barnat et al. |
| 7,104,724 | B2 | 9/2006 | Ferry |
| 7,316,521 | B2 | 1/2008 | Shiomoto et al. |
| 7,714,058 | B2 | 5/2010 | Wilson, Jr. |
| 8,079,778 | B2 | 12/2011 | Colkitt |
| 8,888,403 | B2 | 11/2014 | Atherton |
| 8,926,742 | B2 | 1/2015 | Coe |
| 8,998,529 | B2 | 4/2015 | Ringus et al. |
| 9,306,476 | B2 | 4/2016 | Al-Rubb |
| 9,551,117 | B2 | 1/2017 | Coe |
| 10,378,161 | B2 | 8/2019 | Whitaker |
| 10,538,884 | B2 | 1/2020 | Harco |
| 2001/0002497 | A1 | 6/2001 | Scuero |
| 2004/0120765 | A1* | 6/2004 | Jones, IV ..... E01C 7/187 404/35 |
| 2005/0230515 | A1 | 10/2005 | Hobart |
| 2006/0228962 | A1 | 10/2006 | Souther et al. |
| 2009/0133738 | A1 | 5/2009 | Shiao et al. |
| 2010/0168274 | A1* | 7/2010 | Coe ..... C09J 195/005 106/277 |
| 2013/0156501 | A1 | 6/2013 | Hemphill |
| 2013/0299731 | A1 | 11/2013 | Wright et al. |
| 2014/0270953 | A1 | 9/2014 | Duffy |
| 2015/0126088 | A1 | 5/2015 | Shifferd et al. |
| 2016/0215461 | A1 | 7/2016 | Hays |
| 2016/0369511 | A1 | 12/2016 | Sandhar |
| 2017/0268182 | A1 | 9/2017 | Wigley |
| 2018/0258594 | A1 | 9/2018 | Harco |
| 2018/0371759 | A1 | 12/2018 | Harco |
| 2019/0040593 | A1 | 2/2019 | Tetrault et al. |

* cited by examiner

PAVING MACHINE MEMBRANE DISPENSER

RELATED APPLICATIONS

This application, U.S. patent application Ser. No. 17/475,015 filed Sep. 14, 2021, is a continuation of U.S. patent application Ser. No. 16/748,662 filed Jan. 21, 2020.

U.S. patent application Ser. No. 16/748,662 filed Jan. 21, 2020 is a continuation of U.S. patent application Ser. No. 15/912,325 filed Mar. 5, 2018, now U.S. Pat. No. 10,538,884, which issued on Jan. 21, 2020.

U.S. patent application Ser. No. 15/912,325 claims priority of U.S. Provisional Patent Application Ser. No. 62/466,883 filed Mar. 3, 2017.

The contents of all related applications are incorporated herein by reference.

BACKGROUND

Asphalt pavement is one of the most useful inventions in human society. It provides a low cost surface layer for roads, highways, and multiple other areas where human activity takes place. Asphalt pavement is a combination of two components, asphalt bitumen and suitably sized road gravel. These two components are blended in specific proportions such that the bitumen coats all of the gravel components and bonds them together once they are compacted onto a base surface.

Asphalt bitumen is produced as the end product in the refining of crude oil after lighter components such as gasoline and diesel have been extracted. Road surfacing has turned out to be the perfect end use for the very large quantities of asphalt bitumen which result from the production of fuels to power vehicles, which ultimately need a surface upon which to travel.

It is well understood by experts in the paving industry and even non-experts who drive vehicles over paved roads, that asphalt pavement has one very common and serious flaw which is that it typically develops many cracks at some point in its life. The cracks typically extend through the pavement thickness to the gravel base or subgrade. After this cracking occurs, much expense is usually incurred by towns, cities, governments, and all parties responsible for roads and highways in attempts to render the cracked pavement waterproof with crack sealants applied to the cracks. Crack sealants are typically only applied to the bigger cracks while many smaller less visible cracks remain unsealed and may still allow water penetration. It is well understood by experts in this field that if sufficient rain water penetrates through pavement cracks, it will inevitably enter the subgrade, weaken the subgrade, and eventually lead to more cracking and more maintenance costs, including pot-hole repairs.

Typically after a number of years of paying for annual crack sealing and other crack related maintenance the decision may finally be made to install a new layer of pavement. This usually involves milling out and removing only two to three inches of the old pavement surface but leaving the remainder of the slab intact. The new layer of pavement is then installed over the surface of the remaining old pavement. If no crack isolating membrane is used, as is usually the case, the cracks which still remained in the old sub-layer of pavement will eventually propagate upwards through the new surface layer by a process known as crack propagation. Crack propagation is a well-known process in the engineering field and is usually caused by repetitive stresses. Pavement constantly undergoes such repetitive stresses due to intermittent vehicle traffic and day time heating versus night time cooling thermal stresses. Inevitably after a few years of stresses, the new layer of pavement will crack.

To attempt to prevent or delay cracking of pavement, various interlayer or sublayer, crack isolating materials have been developed for embedment beneath a layer of new pavement.

A common form of interlayer or sublayer material is a composite membrane composed of an asphalt bitumen coated membrane, a non-woven polyester or polypropylene reinforcement fabric coated with an elastomeric polymer modified asphaltic coating. This waterproof sheet is designed to add strength and isolate existing cracks or joints in existing pavement and be a moisture barrier beneath a layer of new pavement. Typically this type of material has a self-adhesive surface on one side so that it can be temporarily adhered to existing pavement prior to a new layer of pavement being installed.

Commercial examples of such materials are Petromat and Pavegard, produced in North America. These are commonly referred to in the trade as SAM Is, Stress Absorbing Membrane Interlayers.

This latter type of membrane is intended to perform three functions, in that it strengthens the overlay pavement making it more resistant to cracking, and secondly it acts as a crack isolator to prevent or delay crack propagation, and thirdly it waterproofs the underside of the new pavement layer so that even if it should eventually crack, moisture will not be able to enter the subgrade, since the membrane itself will not crack due to the flexible nature of its elastomeric coating and it's strong fabric reinforcement. This greatly reduces the potential for pavement cracks and resulting pot-hole formation.

Another type of SAMI is comprised of an uncoated non-woven sheet of full road lane width installed onto a newly sprayed hot tack coat of asphalt cement then embedded with rubber tired rollers. This method requires the use of a tanker truck with a spray dispenser plus other large membrane laying equipment and is usually only used on large highway projects rather than city streets.

One common impediment which often dissuades the use of the SAMI materials is that their method of installation is not always convenient to the pavement installers and their equipment, and it can cause delays in the paving process.

By virtue of the SAMI materials having to be installed on road surfaces prior to the paving process, various problems can result. Such problems are that the material, whether it be a grid type or a self-adhesive membrane type, may not bond well to the prepared road bed. If the roadbed is an asphalt pavement surface which has been milled, which is often the case, its surface will have a rough texture not conducive to forming a bond to a self-adhesive membrane placed over it.

Also once a SAMI interlayer or sublayer material is installed over a prepared road which is to be paved, machinery and trucks laden with hot pavement mix must travel over the installed material. In doing so, problems may occur such as damage or dislodging of the material, causing serious delays in the paving process. Any unexpected delay in a paving operation can be very serious since trucks loaded with hot mix pavement material must be emptied before it might cool and solidify.

As one can readily deduce, the above described difficulties related to the installation of SAMI materials can serve as an impediment to their use and therefore often deprive the parties paying for the new pavement of the very substantial benefits of the said materials. Paving contractors often resist the use of SAMI materials because of the delays they may create. Accordingly, there is a desire to provide a better method of installation of stress absorbing membrane interlayers, or SAMIs.

SUMMARY

One objective of the present invention is to modify a standard asphalt paving machine so that as it moves forward during the paving process it can concurrently dispense and lay down a SAMI material beneath itself and beneath a new layer of hot mixed asphalt pavement which it is at the same time dispensing.

This objective is accomplished by the use of one or a plurality of membrane dispensing shafts mounted to a standard asphalt paving machine. These said membrane dispensing shafts are designed to hold wound-up rolls of membrane and dispense the said membrane material in strips beneath the paving machine as it moves forward. Each roll of said membrane may contain 20 or more linear meters (66 ft.) of material preferably 1 meter (40 in.) wide. The length in each roll should result in a roll weight which is suitable for a worker to lift. As each roll becomes fully dispensed, a new roll can be very quickly installed by a worker onto each dispensing shaft and torch-welded to the trailing end of the dispensed roll, so that the paving process can continue with a minimum of interruption. The mounting position of the said membrane dispensing shafts must be such that the said membrane is preferably laid with one edge of each strip over-lapping the edge of each adjacent strip by about 3 inches. The overlapped edges will bond the dispensed strips together under heat and pressure from the overlain hot pavement, resulting in a final membrane width of about 4.5 meters (15 ft.), or one typical lane of traffic. Alternately the said membrane can be laid with all membrane edges in very close proximity to each other but not overlapped.

The present invention will make it much more convenient and relatively trouble free to install a SAMI membrane beneath new asphalt pavement, resulting in much longer lasting pavement, having fewer cracks and virtually no expense of pothole repair, which can save society significant amounts of money during the lifetime of their streets and highways.

The present invention may be embodied as an asphalt paving system for dispensing hot asphalt material to form a paved surface. In this context, the asphalt paving system comprises an asphalt paving machine, a plurality of dispensing shafts, and a plurality of rolls of pavement reinforcing membrane. The asphalt paving machine comprises a hopper configured to store the hot asphalt material. The plurality of dispensing shafts are mounted on the asphalt paving machine. At least a portion of at least one dispensing shaft extends from at least one side of the paving machine. At least a portion of at least one dispensing shaft extends to a front of the paving machine. Each roll of pavement reinforcing membrane is supported by one of the plurality of dispensing shafts. As the asphalt paving machine moves, the plurality of dispensing shafts dispense the pavement reinforcing membrane continuously beneath the asphalt paving machine and the hot asphalt material is dispensed from the hopper on top of the pavement reinforcing membrane beneath the asphalt paving machine.

DETAILED DESCRIPTION

Figure 1:
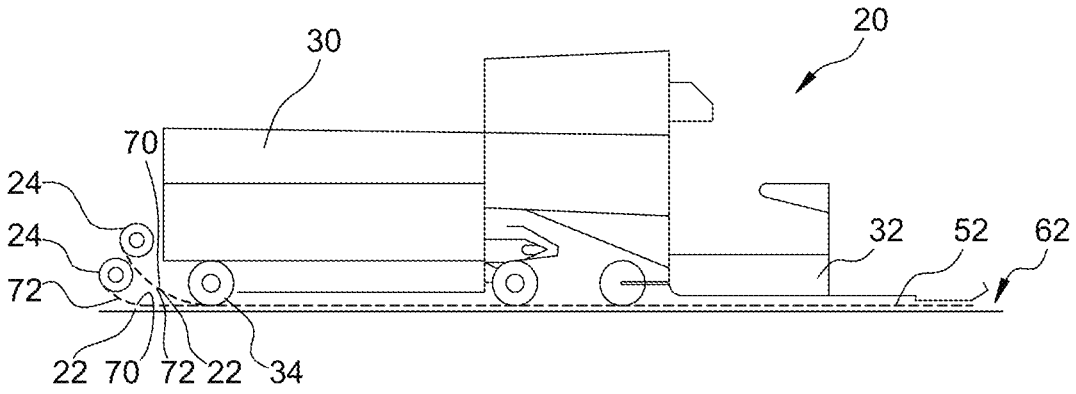
FIG. 1 shows a side view of the first example paving machine in which side membrane dispensing shafts 40-003, and 40-005 are shown, and mounted rolls 24 of membrane 22 are shown.
Figure 2:
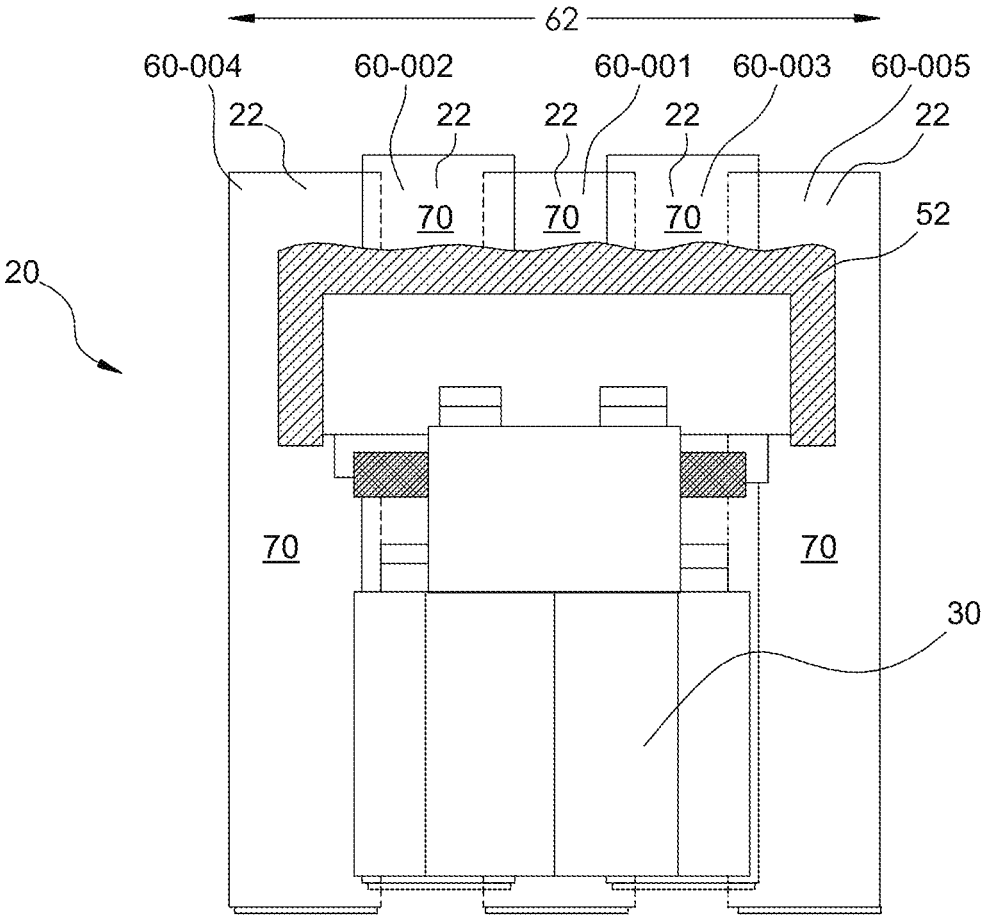
FIG. 2 shows a top plan view of the first example paving machine, 20, in which front center membrane dispensing shaft 40-001, under-track dispensing shafts 40-002 and 40-003, and side dispensing shafts 40-004 and 40-005 are shown and a schematic view of dispensed full width membrane, 006, beneath a pavement layer, 52, is presented.
Figure 3:
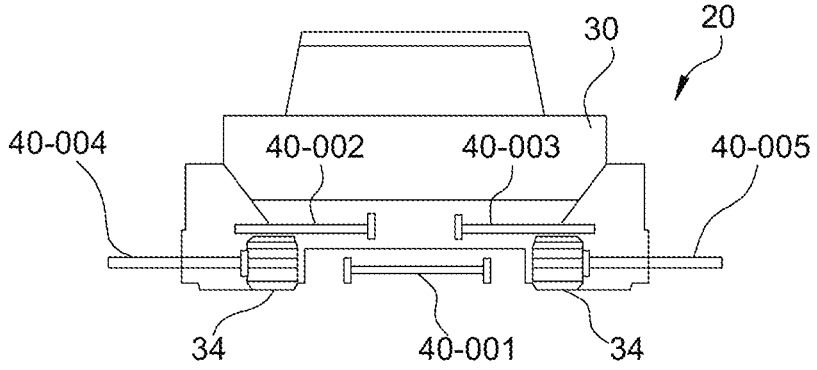
FIG. 3 shows a front view of the first example paving machine in which center membrane dispensing shaft 40-001, is shown, and under-track dispensing shafts 40-002 and 40-003 are shown, and side membrane dispensing shafts, 40-004 and 40-005 are shown.
Figure 4:
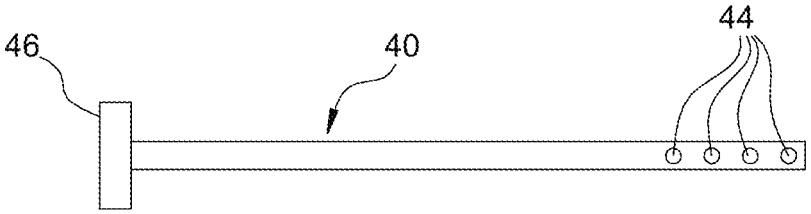
FIG. 4 shows a detail of a membrane dispensing shaft, 40, with support hub 46.

One preferred aspect of the present invention is to provide modifications to a typical asphalt paving machine 20, which modifications would enable the said machine 20 to dispense a stress absorbing membrane interlayer 22, or SAMI, beneath the machine 20 as the machine 20 moves forward. FIG. 1 illustrates that the membrane 22 is wound up onto rolls 24 prior to laying by the machine 22. The example asphalt paving machine 20 comprises a hopper 30, a screed 32, and supporting tracks 34. The said modifications would preferably consist of a multiple number of membrane dispensing shafts 40 attached to the lower front and each side of the said machine 20. As is perhaps best shown in FIGS. 2 and 3, the example machine 20 comprises five of the dispensing shafts 40. Each dispensing shaft further comprises a support hub 44. The said membrane dispensing shafts 40 are designed to hold the wound-up rolls 24 of the heat-bondable SAMI membrane 22 and continuously allow dispensing of the said membrane 22 onto a road bed 50 beneath the said paving machine 20 and beneath concurrently dispensed hot pavement mix or layer 52 as the machine 20 moves forward. The combination of the modified asphalt paving machine 20, membrane 22, and hot pavement mix 52 will be referred to herein as an asphalt paving system.

The said membrane dispensing shafts 40 shall be preferably made of round metal tubing having an outer diameter of about 62 mm. (2.5 inches). The lengths of the said dispensing shafts 40 would about 1.3 m (4 ft.) but may be varied to suit their mounting positions. The preferred positioning of the said dispensing shafts 40 would be such to dispense the membrane 22 in adjacent separate strips 60 to cover the width of the lane 62 being paved. The retaining pins 42 would be inserted through the holes 44 in the said dispensing shafts 40 in order to hold the rolls 24 of membrane 22 in place as the membrane 22 is unwound from the rolls 24.

Preferably the center membrane strip 60-001 mounted on shaft 30-001 on the drawing herein, dispensed at the front of the machine 20 would cover a portion of the space between the paving machine supporting tracks 34 which space is typically about 60 inches in width. Preferably separate strips 60-002 and 60-003 of membrane mounted on shafts 30-002 and 30-003 herein, would be dispensed beneath each of the machine's tracks and be wider than the said tracks to overlap each edge of the said center strip 30-001. And preferably each of two side strips 60-004 and 60-005 of membrane 22, mounted on shafts labelled as 30-004 and 30-005 herein, would be dispensed on the outer side of each supporting track 34 to cover the required lane width of about 4.5 meters or 15 ft. Preferably the edge of each said strip 60 of membrane would overlap the adjacent membrane strip 60 by about 3 inches or greater. However alternatively the membrane edges may be positioned to not overlap each other. The hot pavement mix 52 concurrently being dispensed and spread by the said paving machine 20 would preferably overlay and cover the said membrane strips 60, transfer heat to them, and heat-activate upper and lower adhesive surfaces 70 and 72 of the strips 60 to facilitate bonding of the said membrane 22.

By dispensing separate said membrane strips 60-002 and 60-003 beneath each of the paving machine's support tracks 34, any distortion or wrinkling of the membrane 22 that the tracks 34 may cause during forward motion will be limited to those two strips 60-002 and 60-003 only and not affect the full width of the membrane 22 as might otherwise occur.

A second aspect of the present invention is to provide a "novel method of paving" whereby the mechanically altered asphalt paving machine 20 can be operated to dispense a Stress Absorbing Membrane Interlayer or SAMI 22 beneath itself as the paving machine 20 moves forward while concurrently dispensing the layer of hot pavement mix 52 over the said membrane 22. As in the normal asphalt paving procedure hot asphalt paving material 52 is intermittently delivered by a dump truck or other means (not shown) into the hopper 30 of the paving machine 20, thence conveyed towards the rear of the machine 22 to a screed area and dispensed onto the road surface 50 in a thickness and width controlled by the screed 32. With the present invention, the hot asphalt 52 would instead end up on the top surface of a concurrently dispensed pavement membrane 22 beneath the paving machine 20 and be screeded to a desired thickness, for subsequent roller compaction (not shown).

A third aspect of the present invention is to provide a "novel SAMI membrane" 22 in wound-up roll form, being about 2.5 mm. (3/32 in.) thick and about 1 meter wide (40 in.), which is comprised of a non-woven polymer fabric coated with a heat-bondable elastomeric modified asphalt bitumen coating and mineral sand surfacing. Bonding of this membrane 22 in place beneath hot pavement can occur due to the heat sensitive adhesive coating on the membrane becoming tackified by heat transfer from overlain hot pavement 52.

Currently used SAMI membranes must be pre-bonded in place with a hot-sprayed asphalt adhesive or have to be made to be self-adhesive with a removeable release layer so they can be bonded in place prior to paving over them. This requires the added labor and cost of spraying hot asphalt or removing and disposing of a costly release material. The advantage of the novel SAMI membrane of the present invention is that this said membrane can be dispensed by a suitably modified paving machine 22 and heat-bonded in place with lower overall cost.

The foregoing descriptions and illustrations should not be considered to limit the scope of this invention. Numerous modifications and changes may become evident to those skilled in the art, and accordingly all suitable modifications and equivalence are considered to fall within the scope of the invention as defined by the claims and descriptions stated herein.

The following patent citations are listed herein for reference purposes only, as there is no noted conflict with the present invention described on the pages herein.

Given the foregoing, it should be apparent that the present invention may be embodied as modifications to an asphalt paving machine which modifications consists of one or a plurality of mounted membrane dispensing shafts which said shafts can hold and allow the dispensing of a pavement reinforcing membrane continuously beneath a paving machine as it moves forward. A membrane dispensing shaft of the present invention may be mounted on the front, or leading, portion of the paving machine or may also be mounted on the sides or center area of the said paving machine. A membrane dispensing shaft of the present invention may be positioned such that the membrane dispensing shaft can allow dispensing of the said membrane in multiple strips to cover the center width between the machine's two tracks, and concurrently to cover the area beneath each of the machines two support tracks, and concurrently to cover the lateral area on the outer side of each of the machines two tracks, with or without the side edges of each membrane overlapping each adjacent membrane edge. A membrane dispensing shaft of the present invention may be positioned in a manner so that the edges of the said pavement reinforcing membrane strips dispensed from each shaft will overlap the edge of each adjacent dispensed membrane strip.

The present invention may also be embodied as a method of asphalt paving whereby an asphalt paving machine with special membrane dispensing shafts can continuously dispense a pavement reinforcing membrane onto a surface and concurrently dispense hot paving mix onto the said membrane as it moves forward. A method of the present invention may further comprise the step of supplying a pavement reinforcing membrane supplied as rolls and produced by hot-coating and sand surfacing both faces of a non-woven polymer fiber reinforcement sheet with an elastomeric modified asphalt bitumen coating which is formulated to have a heat-activated bonding surface. A method of the present invention may further comprise a pavement reinforcing membrane having elastomeric modified asphalt bitumen coating containing the elastomeric Styrene Butadiene Styrene polymer modifier commonly known as SBS polymer. The elastomeric modified asphalt bitumen coating of the present invention may comprise a polymer modifier that may be a Styrene Isoprene Styrene polymer, commonly known as SIS, alone or combined with an SBS polymer, or otherwise suitable polymers.

The present invention may also be embodied as a novel pavement reinforcing membrane in which the elastomeric asphalt coating may contain polymer modifier percentages ranging from 0% to 25% with a preferred total percentage of 10%. The non-woven polymer reinforcement sheet of the pavement reinforcing membrane of the present invention may be made of polyester fibers. The non-woven polymer reinforcement sheet of the pavement reinforcing membrane of the present invention may be made of other suitable polymer fibers such as polypropylene, or a combination of other suitable fibers. The preferred asphalt bitumen utilized to blend with polymer modifier to coat the pavement reinforcing membrane is a standard paving grade of asphalt bitumen commonly known as 80/100 penetration grade, however other penetration or roofing grades of asphalt bitumen may be utilized also with or without added tackifying agents.

The present invention is directed to an improved design and improved method of installation of stress absorbing membrane interlayers, commonly known as SAMIs, used for strengthening and waterproofing asphalt pavements in road or highway surfacing operations. By a novel method of modifying a standard paving machine the present invention makes it easier and more convenient to install SAMI membranes beneath a layer of new asphalt pavement, thus providing greater resistance to pavement cracking resulting in lower overall maintenance costs.

What is claimed is:

1. An asphalt paving system for use with an asphalt paving machine to dispense hot asphalt material to form a paved surface, the asphalt paving machine comprising a hopper and defining a front, first and second sides, and a center area between the first and second sides, the asphalt paving system comprising:

a plurality of dispensing shafts adapted to be mounted on the asphalt paving machine such that at least a portion of at least one of the plurality of dispensing shafts extends beyond the first side of the paving machine, at least a portion of at least one of the plurality of dispensing shafts extends beyond the second side of the paving machine, and at least a portion of at least one of the plurality of dispensing shafts extend from the front of the paving machine and is arranged entirely within the center area of the paving machine; and a plurality of rolls of pavement reinforcing membrane, wherein the pavement reinforcing membrane is asphalt bitumen coated, and each of the plurality of dispensing shafts supports one of the plurality of rolls of pavement reinforcing membrane; whereby as the asphalt paving machine moves, the plurality of dispensing shafts dispense the pavement reinforcing membrane continuously beneath the asphalt paving machine, and the hot asphalt material is dispensed from the hopper on top of the pavement reinforcing membrane beneath the asphalt paving machine.

2. An asphalt paving system as recited in claim 1, in which:

each of the plurality of dispensing shafts dispenses the pavement reinforcing membrane in a membrane strip; and the dispensing shafts are arranged such that at least a portion of each of the membrane strips overlaps at least a portion of at least one other membrane strip.

3. An asphalt paving system as recited in claim 1, in which:

each of the plurality of dispensing shafts dispenses the pavement reinforcing membrane in a membrane strip;

at least a portion of at least one of the membrane strips is arranged laterally outside of first side, and at least a portion of at least one of the membrane strips is arranged laterally outside of second side.

4. An asphalt paving system as recited in claim 3, in which at least a portion of each of the membrane strips overlaps at least a portion of at least one other membrane strip.

5. An asphalt paving system as recited in claim 1, further comprising a screed.

6. An asphalt paving system as recited in claim 1, wherein each of the plurality of dispensing shafts is mounted on a leading portion of the asphalt paving machine.

7. An asphalt paving system as recited in claim 1, wherein at least three membrane strips are arranged within the center area of the asphalt paving machine.

8. An asphalt paving system as recited in claim 1, in which the paving machine further comprise first and second supports, where the first support is arranged between the center area and the first side and the second support is arranged between the second area and the second side.

9. An asphalt paving system as system in claim 8, wherein the dispensing shafts are positioned to dispense pavement reinforcing membrane from the plurality of rolls of pavement reinforcing membrane in a plurality of membrane strips, where at least one of the plurality of membrane strips is arranged within the center area, at least one of the plurality of membrane strips is arranged at least partly beneath each of the first and second supports, and at least a portion of at least one membrane strip is arranged laterally outside of the first and second supports.

10. An asphalt paving system as recited in claim 9, in which at least one side edge of each membrane strip overlaps at least one side edge of at least one adjacent membrane strip.

11. An asphalt paving system as recited in claim 9, in which at least one side edge of at least one membrane strip does not overlap a side edge of an adjacent membrane strip.

12. An asphalt paving system as recited in claim 1, in which the pavement reinforcing membrane comprises:

a non-woven polymer fiber reinforcement sheet both surfaces of which are hot-coated and sand surfaced with an elastomeric modified asphalt bitumen coating forming a heat-activated bonding surface, where the elastomeric modified asphalt bitumen coating is modified with 0% to 25% of a polymer modifier; wherein the non-woven polymer reinforcement sheet is made of polyester fibers;

the asphalt bitumen blended with the polymer modifier to coat the membrane is 80/100 penetration grade; and the elastomeric modified asphalt bitumen coating contains an elastomeric polymer modifier.

13. An asphalt paving system as recited in claim 12, in which the polymer modifier is a Styrene Isoprene Styrene polymer.

* * * * *